US012072140B2

(12) United States Patent
Raskar

(10) Patent No.: US 12,072,140 B2
(45) Date of Patent: Aug. 27, 2024

(54) INSULATION MATERIALS FOR A HEAT AND SOUND INSULATED STRUCTURE AND METHODS OF FORMING WITH A MOLD THAT IS GAS AND LIQUID PERMEABLE

(71) Applicant: WHIRLPOOL CORPORATION, Benton Harbor, MI (US)

(72) Inventor: Devidas B. Raskar, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 753 days.

(21) Appl. No.: 17/137,831

(22) Filed: Dec. 30, 2020

(65) Prior Publication Data

US 2022/0205709 A1 Jun. 30, 2022

(51) Int. Cl.
*F25D 23/06* (2006.01)

(52) U.S. Cl.
CPC ..... *F25D 23/064* (2013.01); *F25D 2201/124* (2013.01); *F25D 2201/14* (2013.01)

(58) Field of Classification Search
None
See application file for complete search history.

(56) References Cited

U.S. PATENT DOCUMENTS 3,179,549 A 4/1965 Strong et al.
3,289,423 A 12/1966 Berner et al.
3,925,580 A * 12/1975 Brewer ..... B05D 1/02 427/372.2
4,514,450 A 4/1985 Nowobilski et al.
5,009,084 A * 4/1991 Tanaka ..... F25D 17/065 62/DIG. 13
5,032,439 A 7/1991 Glicksman et al.
5,327,703 A 7/1994 Cur et al.
6,132,837 A * 10/2000 Boes ..... F16L 59/065 156/286
8,281,558 B2 10/2012 Hiemeyer et al.
9,151,435 B2 10/2015 Lee et al.
9,464,751 B2 10/2016 Toshimitsu et al.
10,006,581 B2 6/2018 Kuhn et al.
10,274,247 B2 4/2019 Jeong et al.
10,584,914 B2 3/2020 Jung et al.
2004/0011749 A1* 1/2004 Hutchinson ..... B01D 29/23 210/406

(Continued)

FOREIGN PATENT DOCUMENTS

CN 104373765 A 2/2015
EP 0658717 B1 3/1998

(Continued)

*Primary Examiner* — Xiao S Zhao
*Assistant Examiner* — Guy F Mongelli
(74) *Attorney, Agent, or Firm* — Price Heneveld LLP

(57) ABSTRACT

A method and system for forming an insulation package for use in a vacuum insulated structure is provided. A slurry containing a liquid and an insulation material is formed. The slurry can be supplied to an envelope under vacuum, wherein the envelope is gas-permeable and permeable to the liquid. At least a portion of the liquid is drawn through the envelope and at least a portion of the insulation material is retained within the envelope to form an insulation package. One or more insulation packages can be disposed within an insulating cavity and the insulating cavity can be evacuated to decrease a pressure therein to form a vacuum insulated structure.

17 Claims, 7 Drawing Sheets

(56) References Cited

U.S. PATENT DOCUMENTS

2004/0058119 A1* 3/2004 Wynne ..... B29C 53/063 428/69
2004/0132846 A1* 7/2004 Leventis ..... C01B 33/145 521/128
2006/0035054 A1* 2/2006 Stepanian ..... B32B 27/308 428/76
2007/0232178 A1* 10/2007 Polat ..... D04H 1/435 162/157.1
2009/0031745 A1* 2/2009 Neumann ..... F25D 29/005 362/94
2011/0047934 A1 3/2011 Brown
2011/0126936 A1* 6/2011 Dawson ..... B65B 31/024 141/10
2011/0129398 A1* 6/2011 Markowz ..... B01J 20/18 423/230
2013/0123528 A1* 5/2013 Tada ..... C23C 16/345 556/407
2013/0221011 A1* 8/2013 Yoon ..... F25D 23/06 156/196
2014/0057083 A1* 2/2014 Imae ..... C04B 14/064 264/319
2014/0151593 A1* 6/2014 Yin ..... B29C 44/28 427/373
2014/0196305 A1* 7/2014 Smith ..... F28D 20/023 34/468
2014/0287641 A1* 9/2014 Steiner, III ..... F41H 5/0471 428/317.1
2016/0200891 A1* 7/2016 Virgilio ..... B01D 71/027 424/492
2018/0202701 A1* 7/2018 Kim ..... F25D 11/04
2018/0339490 A1 11/2018 Park et al.
2019/0126591 A1* 5/2019 Hossieny ..... B32B 27/40
2023/0142450 A1* 5/2023 Bartlett ..... C04B 35/6264 106/712

FOREIGN PATENT DOCUMENTS

EP 2614193 B1 7/2015
JP 04198688 A 7/1992
JP 2016173149 A 9/2016
KR 101012664 B1 2/2011
WO 2012031789 A1 3/2012
WO 2014195298 A1 12/2014
WO 2019199278 A1 10/2019

* cited by examiner

INSULATION MATERIALS FOR A HEAT AND SOUND INSULATED STRUCTURE AND METHODS OF FORMING WITH A MOLD THAT IS GAS AND LIQUID PERMEABLE

BACKGROUND OF THE DISCLOSURE

The present disclosure generally relates to methods and systems for forming insulation materials for use in vacuum insulated structures, and more specifically, to insulation materials for use in vacuum insulated structures used in appliances, such as refrigerators and freezers, and methods of forming said insulation materials.

SUMMARY OF THE DISCLOSURE

According to one aspect of the present disclosure, a method of forming an insulation package is provided. The method includes forming a slurry containing a liquid and an insulation material in a vessel. An envelope is provided inside a sealed chamber, wherein the envelope is gas-permeable and permeable to the liquid and defines an envelope interior cavity. The envelope can be fluidly coupled with the interior cavity of the vessel. At least a portion of the slurry can be drawn from the vessel into the envelope interior cavity by decreasing a pressure within the chamber to less than ambient pressure. At least a portion of the liquid can be drawn from the slurry in the envelope interior cavity through the envelope, wherein at least a portion of the insulation material is retained within the envelope interior cavity to form an insulation material filled envelope.

According to another aspect of the present disclosure, a method of forming a vacuum insulation structure is provided. The method includes supplying a slurry containing a liquid and an insulation material to an interior cavity of an envelope, wherein the envelope is gas-permeable and permeable to the liquid. At least a portion of the liquid is drawn through the envelope under vacuum, wherein at least a portion of the insulation material is retained within the envelope interior cavity to form an insulation material filled envelope. The insulation material filled envelope is sealed with the insulation material therein to form an insulation package. An inner liner is sealed with an outer wrapper to form an insulating cavity, wherein the insulation package is disposed within the insulating cavity. The method also includes evacuating air from the insulating cavity through at least one vacuum port.

According to another aspect of the present disclosure, a system for forming insulation packages is provided. The system includes a vessel configured to hold a slurry containing a liquid and an insulation material. A supply conduit is coupled at a first end with the vessel and has a second end configured to couple with an envelope for selectively supplying the slurry from the vessel to an interior cavity of the envelope. A chamber is configured to selectively maintain a pressure within the chamber at a reduced pressure less than ambient pressure, wherein the second end of the supply conduit is disposed within the chamber. The system includes a mold having an inner mold liner at least partially defining a cavity for retaining the envelope therein and an outer mold shell at least partially surrounding the inner mold liner, wherein the inner mold liner and outer mold shell are gas-permeable and permeable to the liquid.

These and other features, advantages, and objects of the present disclosure will be further understood and appreciated by those skilled in the art by reference to the following specification, claims, and appended drawings.

Figure 1:
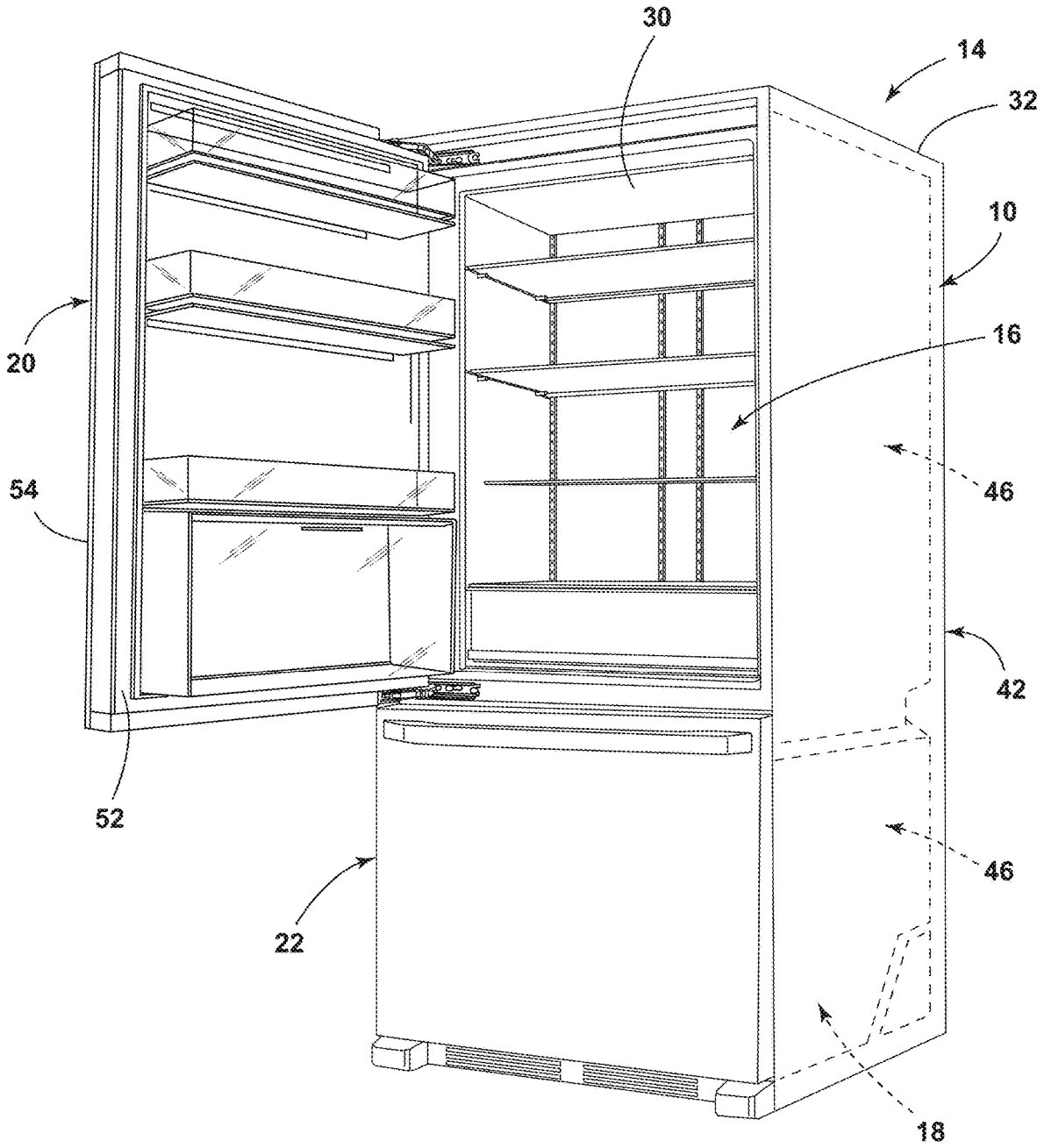
FIG. 1 is a front perspective view of an appliance including a vacuum insulated structure, according to aspects of the present disclosure.

The components in the figures are not necessarily to scale, emphasis instead being placed upon illustrating the principles described herein.

DETAILED DESCRIPTION

The present illustrated embodiments reside primarily in combinations of apparatus components and method steps relating to insulation materials for use in vacuum insulated structures, such as may be used in insulating home appliances. Vacuum insulated structures may be utilized in appliances to limit or control the transfer of heat and/or sound. Typically, a vacuum insulated structure is formed by providing an insulation material within a sealed insulating cavity. The insulating cavity is then evacuated, for example using a vacuum pump, to decrease the pressure within the insulating cavity relative to ambient pressure and thus form a vacuum insulation structure. Conventional insulation powders used in home appliances, such as fumed silica and carbon black, typically have a low density, which can make these types of insulation materials difficult to handle during the process of filing an insulating cavity with the insulation material. One method for addressing the handling challenges associated with these type of low density powders includes the use of vibration to facilitate distribution of the insulation powder within the insulating cavity. However, it can be challenging and time consuming to uniformly distribute the powder within the insulating cavity using vibration, particularly along the corners and edges of the cavity structure. As the shape of the insulating cavity increases in complexity, it can also become increasingly challenging to uniformly distribute the insulation powder within the insulating cavity. The uniformity of the insulation powder distribution may affect the overall thermal conductivity of the insulating cavity and/or may affect the ability to achieve a desired final vacuum density within the insulating cavity while also avoiding damage or deformation to the walls forming the insulating cavity.

Aspects of the present disclosure relate to methods and systems for forming insulation packages for use in vacuum insulated structures. The insulation packages include a gas-permeable envelope containing an insulation material. The envelopes can be placed within an insulating cavity and the insulating cavity can be evacuated to form a vacuum insulated structure. The process for filling the envelope with the insulation material includes forming a slurry containing a liquid and an insulation material and using a pressure differential (i.e., a vacuum) to draw the slurry into the envelope. The envelope is gas-permeable and permeable to the liquid such that the pressure differential results in the liquid being drawn through the envelope while at least a portion of the insulation material is retained within the envelope. In this manner, the envelope can be efficiently and uniformly filled with the insulation material. The envelopes can be shaped and dimensioned to be placed within an insulating cavity of a structure, such as a home appliance, which is then evacuated to decrease a pressure within the insulating cavity to form a vacuum insulated structure.

Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Figure 2:
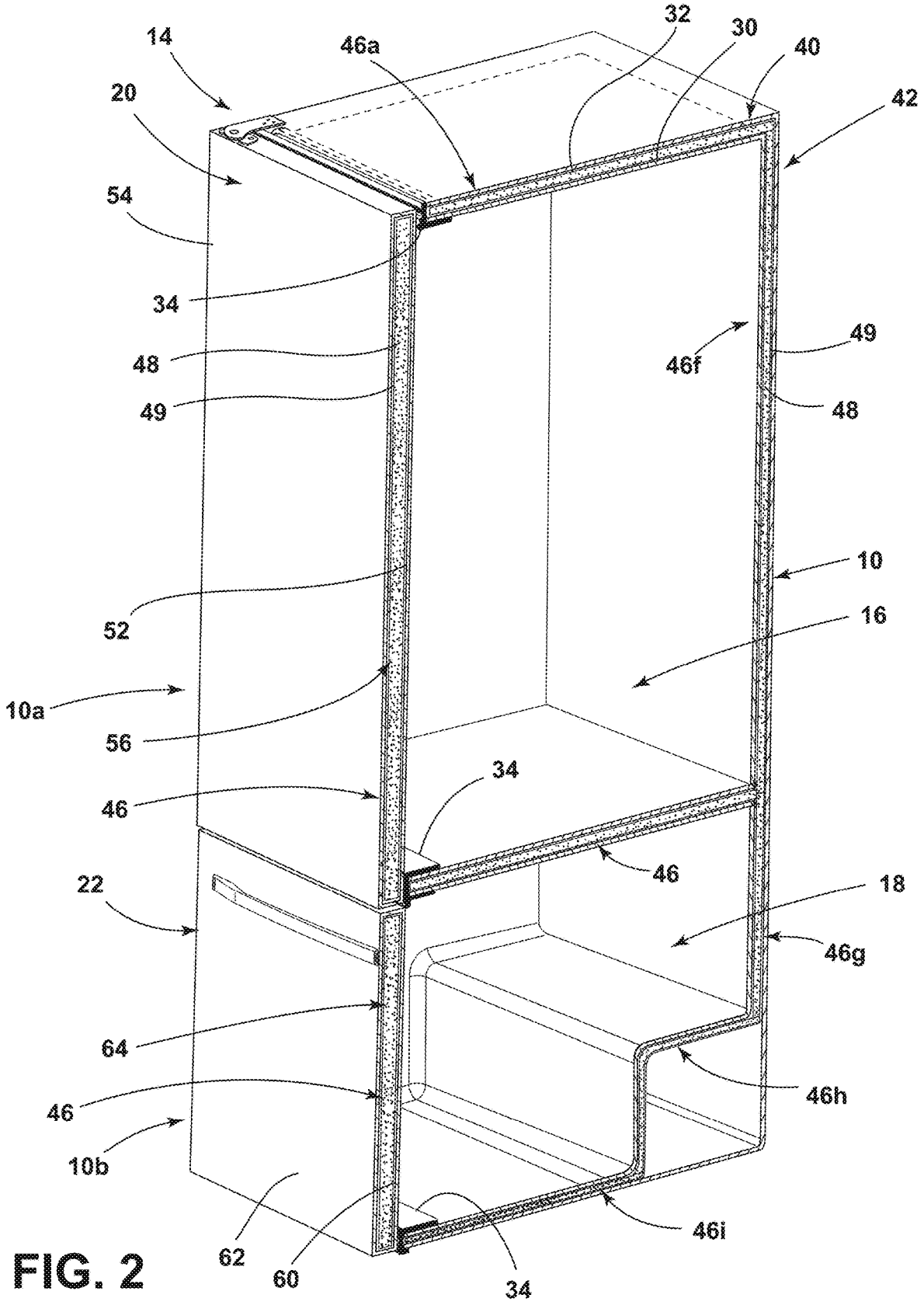
FIG. 2 is a cross-sectional view of the appliance of FIG. 1 including a plurality of insulation packages, according to aspects of the present disclosure.
Figure 3:
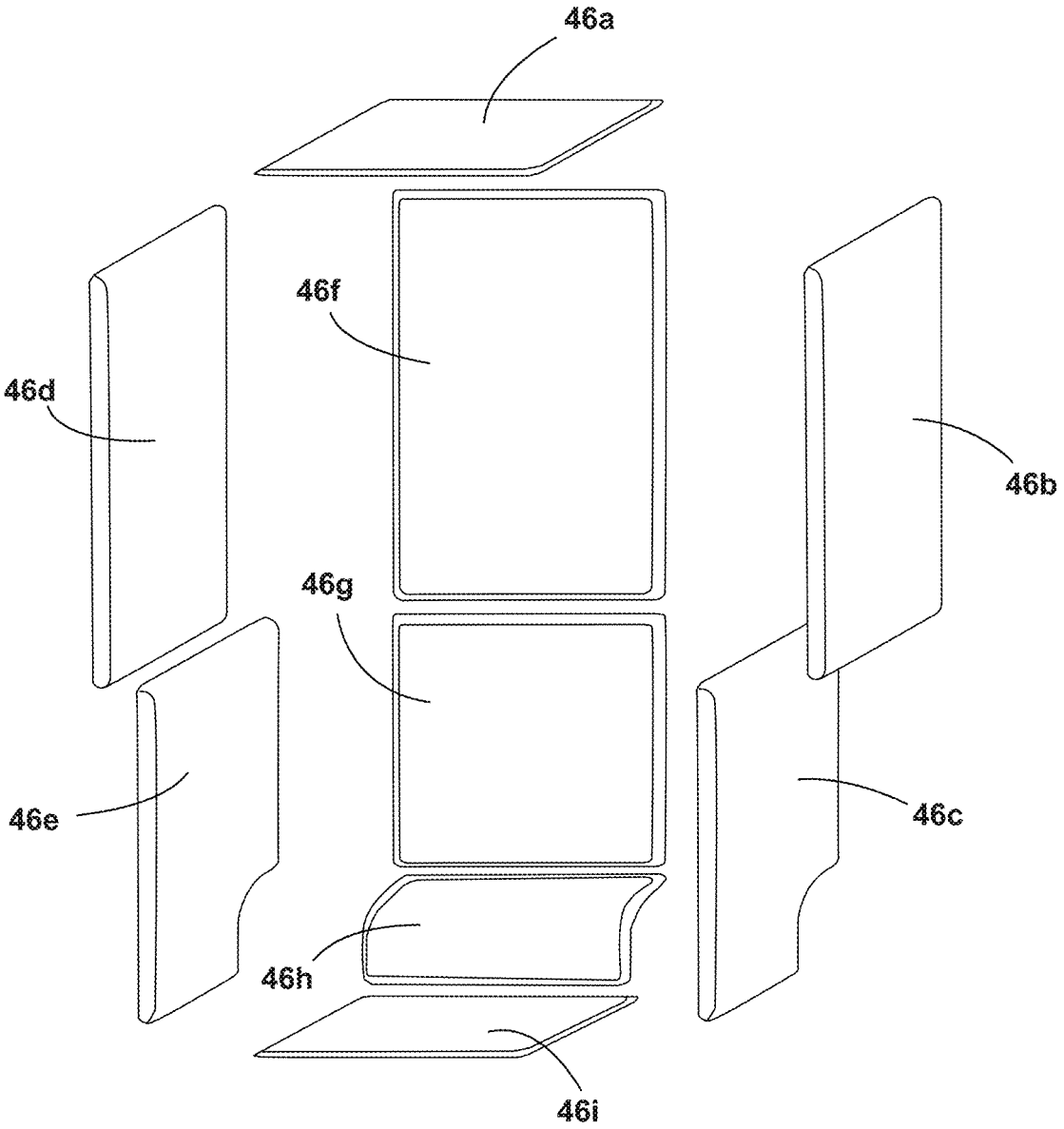
FIG. 3 is an exploded view of a plurality of the insulation packages of the appliance of FIG. 1, according to aspects of the present disclosure.

Referring to FIGS. 1-3, reference numeral 10 generally designates a vacuum insulated structure in the form of a refrigerating appliance 14. The vacuum insulated structure 10 of the present disclosure may be in the form of a vacuum insulated structural cabinet, as illustrated, or a vacuum insulated panel that may be used as an insulation member for the appliance 14. The appliance 14 can be in the form of a refrigerating appliance having a refrigeration compartment 16 and a freezer compartment 18, as illustrated. The appliance 14 can include first and second insulated door assemblies 20 and 22 for selectively providing access to the refrigeration compartment 16 and the freezer compartment 18, respectively. The first and second insulated door assemblies 20 and 22 can be configured to rotate and/or slide between an open and closed position with respect to the appliance 14 to allow for selective access to the refrigeration compartment 16 and the freezer compartment 18, respectively.

The vacuum insulated structure 10 can include an inner liner 30 coupled with an outer wrapper 32 to define an insulating cavity 40 of a cabinet body 42 of the appliance 14. In some embodiments, a trim breaker 34 can be provided for coupling the inner liner 30 with the outer wrapper 32, as illustrated. The inner liner 30, outer wrapper 32, and optional trim breaker 34, can be considered a structural wrapper that defines the insulating cavity 40. A plurality of insulation packages 46 (some of which are individually labeled as 46*a*-46*i* in FIG. 3) are disposed within the insulating cavity 40. Each insulation package 46 comprises an insulation material 48 contained within an envelope 49. The number, dimensions, and shape of each of the insulation packages 46 may be different than what is illustrated in FIGS. 1-3, based at least in part on parameters such as the type of vacuum insulated structure, the type of appliance in which the vacuum insulated structure is being used, the shape and dimensions of the insulating cavity 40, the type of insulation material 48, the type of material forming the envelope 49, etc. The insulation packages may be referred to individually or as a group using the reference numeral 46; when it is desirable to differentiate between multiple insulation packages 46, the suffix "a," "b," "c," etc. may be used.

The appliance 14 can have additional components based on the type of appliance, the details of which are not germane to the aspects of the disclosure, examples of which include a controller, user interface, lights, a compressor, a condenser, an evaporator, an ice maker, a water dispenser, etc. The appliance 14 can also be in the form of a refrigerating appliance including only a refrigeration compartment, only a freezer compartment, or any various combinations and configurations thereof. For example, in non-limiting examples, the refrigerating appliance can be a bottom mount refrigerator, a bottom mount French door refrigerator, a top mount refrigerator, a side-by-side refrigerator, a four-door French door refrigerator, and/or a five door French door refrigerator. While the vacuum insulated structure 10 is described in the context of a refrigerating appliance, it is understood that the vacuum insulated structure 10 can be used in a variety of appliances, examples of which include ovens, dishwashers, water heaters, laundry appliances, and any other appliances that may benefit from thermal and/or sound insulation.

In some aspects, the first and/or second insulated door assemblies 20 and 22 can include a vacuum insulated structure 10*a* and 10*b*, respectively, that includes one or more insulation packages 46. The structure and/or materials of the inner liner and outer wrapper components of the first and second insulated door assemblies 20 and 22 defining the insulating cavity within which the insulation packages 46 can be housed may be the same or different than those of the body of the appliance 14, and thus the vacuum insulated structures of the first and second insulated door assemblies 20 and 22 are labeled with the suffix "a" and "b." The first insulated door assembly 20 can include a first door inner liner 52 and a first door outer wrapper 54, which together define a first door insulating cavity 56. The second insulated door assembly 22 can include a second door inner liner 60 and a second door outer wrapper 62, which together define a second door insulating cavity 64. One or more insulation packages 46 may be present in one or both of the first and second door insulating cavities 56, 64. In some aspects, the insulation packages 46 in the first and second door insulating cavities 56, 64 may contain the same or different envelope 49 and/or insulation material 48 as the insulation packages 46 used in the insulating cavity 40. In some aspects, one or both of the first and second insulated door assemblies 20, 22 does not include the vacuum insulated structure 10*a*, 10*b*. Optionally, the first and second insulated door assemblies 20, 22 may include an aesthetic exterior skin (not shown).

The inner liner 30, outer wrapper 32, optional trim breaker 34, first and second door inner liners 52, 60, and first and second door outer wrappers 54, 62, can be made from any suitable metal, metal-alloy, and/or polymeric material, and may be the same or different. The inner liner 30, outer wrapper 32, and optional trim breaker 34 can be made from materials suitable for maintaining a vacuum within the insulating cavity 40 (i.e., maintain a predetermined lower pressure within the insulating cavity 40, relative to ambient pressure). When the first and second insulated door assemblies 20, 22 include the vacuum insulated structure 10*a*, 10*b*, the first and second door inner liners 52, 60, and first and second door outer wrappers 54, 62 can be made from materials suitable for maintaining a vacuum within the respective first and second door insulating cavities 56, 64.

Referring now to FIGS. 2-3, each of the insulation packages 46 contains an envelope 49 and an insulation material 48. While aspects of the insulation packages 46 are described in the context of those used in the insulating cavity 40, it is understood that the aspects may similarly apply to insulation packages 46 used in the first and second door insulating cavities 56, 64 when the first and second insulated door assemblies 20, 22 include the vacuum insulated structure 10*a*, 10*b*. In some aspects, as illustrated in FIG. 3, the insulating cavity 40 may contain multiple insulation packages 46*a*-46*i* having different shapes and dimensions. FIG. 3 illustrates some of the individual insulation packages 46*a*-46*i* used in the insulating cavity 40 corresponding to the areas near the top, bottom, side, and rear walls of the appliance 14. As illustrated in FIGS. 2-3, the insulation packages 46*a*-46*i* may be individually shaped and dimensioned so as to correspond to the shape and dimensions of the insulating cavity 40 in specific areas of the appliance 14 (e.g., top, bottom, side, and rear walls). In other aspects, the insulating cavity 40 may contain a plurality of insulation packages 46 all having the same shape and dimensions. In some aspects, each of the insulation packages 46 may each include the same envelope material and insulation material 48. In other aspects, one or more of the insulation packages 46 may include an envelope material and/or insulation material 48 that is different than one or more of the other insulation packages 46.

In some aspects, the number, shape, and dimensions of each of the insulation packages 46 may be selected so as to at least partially fill the insulating cavity 40, 56, and/or 64 in which the insulation packages 46 are disposed. In some aspects, the insulation packages 46 are configured to substantially fill the insulating cavity 40, 56, and/or 64 in which the insulation packages 46 are disposed, as illustrated in FIG. 2. In some aspects, at least a portion of the space remaining in the insulating cavity 40, 56, and/or 64 that is unoccupied by an insulation package 46 may contain an insulation filler material. The insulation filler material can be a foam or bulk particulate insulation filler material that is provided to fill at least a portion of the space within the insulating cavity 40, 56, and/or 64 that is not occupied by an insulation package 46. Non-limiting examples of the optional insulation filler material includes polyurethane foam, fumed silica, perlite, precipitated silica, aerogel powder, silicon carbide, carbon black powder, graphite, rice husk, ash powder, diatomaceous earth, cenospheres, glass fiber, and glass microspheres.

The insulation material 48 inside the envelope 49 can include any suitable material or combination of materials, non-limiting examples of which include fumed silica, perlite, precipitated silica, aerogel powder, silicon carbide, carbon black powder, graphite, rice husk, ash powder, diatomaceous earth, cenospheres, glass fiber, and glass microspheres. The insulation material 48 can optionally include one or more additives, non-limiting examples of which include opacifiers, colorants, electrical conductivity additives, radiant energy reflectivity additives, infrared absorbing additives, etc. The insulation material 48 is contained within the envelope 49, which can be made from any suitable material capable of retaining the insulation material 48 within the volume defined by the envelope 49, while also being gas-permeable and permeable to liquid. Non-limiting examples of suitable materials for the envelope 49 include woven or non-woven natural and synthetic textiles, fabric, fleece, glass fiber fleece, and polymeric materials. The envelope 49 can be formed into any desired regular or irregular geometric shape to provide each insulation package 46 with the desired dimensions and cross-sectional shape. Non-limiting examples of suitable cross-sectional shapes for the insulation package 46 include semi-circular, triangular, teardrop, diamond, rectangular, square, rhomboid, hexagonal, and trapezoidal cross-sectional shapes. In some aspects, the envelope 49 is configured to conform to the shape of a particular portion of the insulating cavity 40 in which the insulation package 46 is intended to be installed.

Figure 4:
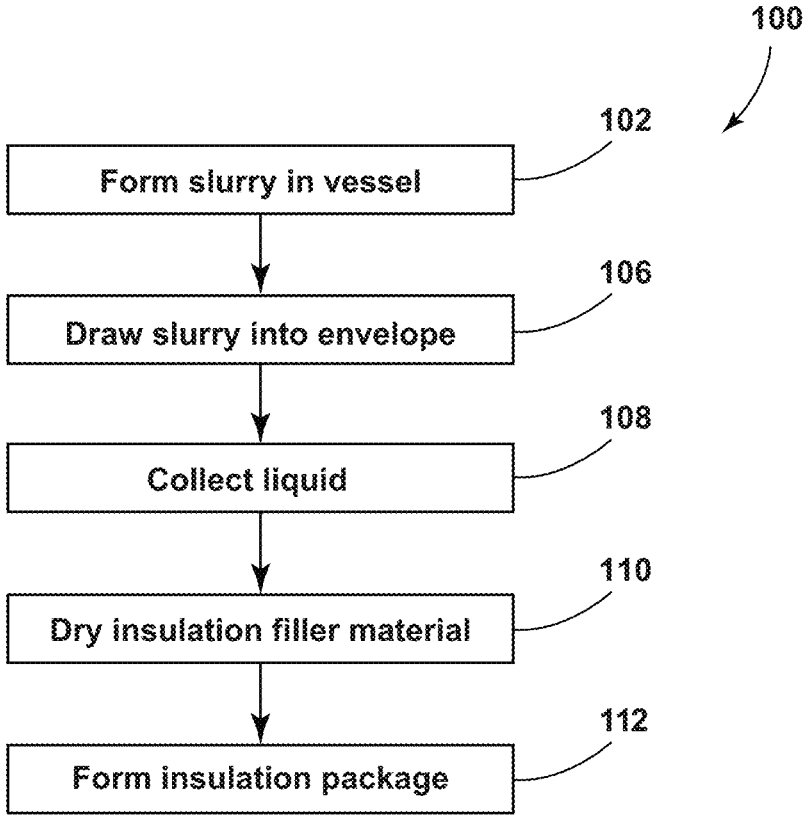
FIG. 4 is a flow chart of a method of forming insulation packages for use in a vacuum insulated structure, according to aspects of the present disclosure.

FIG. 4 illustrates a method 100 for forming an insulation package 46 according to aspects of the present disclosure. The method 100 can be used to form insulation packages 46 for use in the vacuum insulated structures 10, 10*a*, and/or 10*b* of FIGS. 1-2, and any other vacuum insulated structure suitable for use in insulating an appliance.

The method 100 for forming an insulation package 46 can include forming a slurry at 102 containing at least a liquid and an insulation material 48. Optionally, the slurry can include one or more additives that may be desired within the insulation package 46. The slurry at 102 can be formed within a vessel that includes a mixing component, e.g., a mixing blade, for mixing the components of the slurry. The liquid can be any suitable liquid or mixture of liquids capable of suspending the insulation material 48. In some aspects, the liquid is selected in concert with the insulation material 48 such that the insulation material 48 is suspended within the liquid and is not dissolved in the liquid (i.e., the liquid and the insulation material 48 are selected such that the insulation material 48 is insoluble in the liquid). In some aspects, the liquid is a non-aqueous liquid and is preferably an organic liquid. In some aspects, the liquid is a low-moisture or moisture-free liquid, such as a low-moisture or moisture free organic liquid, for example. In some aspects, the liquid may be an anhydrous liquid having less than 1% water content. In some aspects, the anhydrous liquid may have a water content of less than 1%, less than 0.9%, less than 0.75%, less than 0.5%, less than 0.25%, or less than 0.05%. Non-limiting examples of suitable liquids include acetone, methyl ethyl ketone, toluene, and cyclohexane, and mixtures thereof. Residual water content in the insulation packages 46 may increase the amount of time it takes to reach a desired vacuum pressure within the insulating cavity 40 when forming the vacuum insulated structure 10. The use of a low moisture or moisture free liquid can decrease the amount of water remaining in the filled insulation packages 46, which may decrease the amount of time it takes to reach a desired vacuum pressure when forming the vacuum insulated structure 10.

The relative proportion of liquid and insulation material 48 in the slurry can be selected at least in part based on a desired amount of insulation material 48 to fill the envelope 49, the shape and dimensions of the envelope 49, the type of envelope material, the type and/or mixture of liquid, the type and/or mixture of insulation materials 48, etc. In some aspects, the relative proportion of liquid and insulation material 48 can be determined experimentally. For example, if the ratio of liquid to insulation material 48 is too low, the viscosity of the slurry may be too high to uniformly fill the envelope 49 within an acceptable period of time and using an acceptable pressure. In another example, if the ratio of liquid to insulation material 48 is too high, it may take too long to uniformly fill the envelope 49 with a sufficient amount of insulation material 48.

The vessel can be fluidly coupled with an envelope 49 for supplying the slurry to an interior cavity of the envelope 49 under vacuum (i.e., under a reduced pressure less than ambient pressure). At 106, the slurry can be drawn into the interior cavity of the envelope 49 due to the pressure differential between the interior of the vessel and the interior cavity of the envelope 49, and thus may also be referred to as a vacuum filling process. The envelope 49 is formed from a material that is gas-permeable and permeable to the liquid, but which is configured to retain at least a portion of the insulation material 48. As the slurry is drawn under vacuum from the vessel and into the interior cavity of the envelope 49, the insulation material 48 is retained within the envelope 49, while the liquid is drawn through the envelope 49. The material forming the envelope 49, the insulation material 48, and the liquid are selected in concert such that during the process of drawing the slurry into the envelope 49 at step 106, the liquid can pass through the envelope 49 and at least a portion of the insulation material 48, preferably a majority of the insulation material 48, is retained within the interior cavity of the envelope 49. For example, the material forming the envelope 49 can have an average pore size that is smaller than the average diameter of the particles of the insulation such the liquid is allowed to pass through, while a majority of the insulation material 48 is retained within the envelope 49.

It is generally understood that particulate insulation materials may be characterized by a distribution of particle diameters rather than a single, uniform particle diameter. These variations in particle diameter may be due at least in part to natural variations in materials and/or manufacturing processes. This particle diameter distribution may result in some particles having a particle diameter smaller than the average pore size of a particular envelope 49, such that these particles may pass through the envelope 49 during the process of drawing the slurry into the envelope at step 106. In addition, the envelope material 49 may have a distribution of pore sizes, rather than a single, uniform pore size, which may also account for some particles being able to pass through the envelope 49 rather than being retained therein. The variations in particle diameter of the insulation materials 48 and pore diameter in the envelope material can be taken into consideration when selecting the insulation materials 48 and the material for the envelope 49. The amount of insulation material 48 that is likely to be retained within the envelope 49 and the amount of insulation material 48 that may pass through the envelope 49 during the drawing process at 106 may be based at least in part on the particle diameter of the insulation materials 48 and the pore diameter of the material forming the envelope 49. For example, if an unacceptable amount of insulation material 48 passes through the envelope 49 during the drawing process at 106, an insulation material 48 having a larger average particle diameter and/or an envelope material having a smaller average pore size may be selected. In another example, if an unacceptable amount of insulation material 48 passes through the envelope 49 during the drawing process at 106, a second layer of envelope material may be added (i.e., forming a double-layer envelope 49) to decrease the amount of insulation material 48 passing through the envelope 49 during the drawing process at 106. In another example, if the amount of slurry being drawn into the envelope 49 is too small and/or the rate of drawing is too slow, an envelope material having a larger pore size may be selected to increase the rate of air flow and/or flow of liquid through the envelope material.

At step 108, the liquid that is drawn through the envelope 49 during the drawing process at 106 can be collected. In some aspects, the collected liquid may be removed for proper disposal. In some aspects, the collected liquid may be recycled for use in forming a slurry in a future process 102. In one example, the collected liquid at 108 may be supplied back into the vessel where the slurry is being formed at 102 for use in filling a subsequent envelope 49. In this manner, the method 100 may be considered a closed-loop process with respect to the liquid. Optionally, the collected liquid may be processed prior to being re-used to form a slurry at 102, for example by filtering to remove suspended insulation material 48 and/or by treating in a drying process.

Once a desired amount of insulation material 48 has been drawn into the envelope 49, the envelope 49 can be sealed closed to form the insulation package 46 at 112. The envelope 49 can be sealed in any suitable manner, non-limiting examples of which include sewing, adhesives, heat-sealing, etc. The filled envelope 49 may be treated according to any additional post-filling processes to form the insulation packages 46, such as the optional drying process 110 discussed below, cleaning of the insulation package 46 to remove excess insulation material 48, etc.

The method 100 may include an optional drying process at 110. The drying process 110 can occur prior to the final process for forming the insulation package 46 at 112 and/or after the final processing steps for forming the insulation package 46. Residual water content in the insulation packages 46 may increase the amount of time it takes to reach a desired vacuum pressure within the insulating cavity 40 when forming a vacuum insulated structure 10. The drying process at 110 can be used to evaporate residual water (and remaining liquid) to decrease the water content of the insulation packages 46. In addition, as discussed above, the liquid can be a low-moisture or moisture-free liquid to decrease the amount of water present in the insulation package 46 after filling at step 106. The drying process at 110 may include heating the insulation package 46 using any suitable type of heating system, examples of which include radiant heating, infrared heating, a halogen lamp, electric heating element, convection heating, a drying oven, etc. The time and temperature of the drying process 110 may vary depending on the moisture level, the liquid, the insulation material 48, and/or the envelope material. In one example, for an insulation package 46 made using a slurry of fumed silica and carbon black, and acetone as the liquid, and an envelope 49 made from a fleece material, the filled insulation package 46 may be dried at about 65° C. for about 1.5 hours in the drying process at 110.

In some aspects, the drying process at 110 can occur at higher temperatures and the envelope 49 can be made from a material having a heat stability. Heating at higher temperatures may decrease the drying time required to reach a predetermined water content level. For example, a glass fiber fleece material will have a higher heat stability than a conventional fleece material, allowing for the insulation package 46 to be heated at higher temperatures during the drying process 110 without melting/combusting the envelope 49. Optionally, in some examples, it may be desired to remove the envelope 49 in the drying process 110 by heating the insulation package 46 to a temperature sufficient to melt/combust the envelope 49. For example, as discussed above, it may be desirable to use multiple layers of material in forming the envelope 49 to facilitate retaining a desired amount of insulation material 48 while allowing a desired flow of the liquid through the envelope 49 during the vacuum drawing at 106. One of the multiple layers may be made from a heat resistant material, such as glass fiber fleece, while the other layer(s) are made from a material that will combust/melt at the temperature used during the drying process 110, leaving behind only the heat resistant envelope material and the insulation material 48 after drying.

Figure 5:
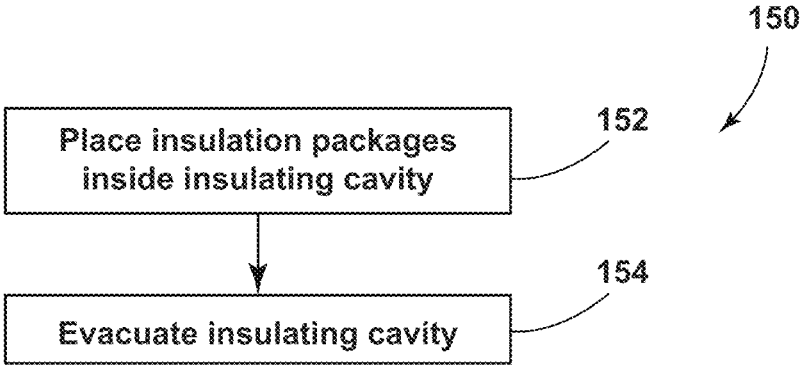
FIG. 5 is a flow chart of a method of forming a vacuum insulated structure having an insulation package disposed therein, according to aspects of the present disclosure.

Referring to FIG. 5, the insulation packages 46 formed at step 112 of the method 100 can be used in a method 150 for forming a vacuum insulated structure, such as any of the vacuum insulated structures 10, 10*a*, and/or 10*b*, for example. The insulation packages 46 can be disposed within an insulating cavity at step 152. The insulating cavity can be formed by sealing an inner liner and an outer shell together, such as described with reference to the exemplary embodiments of FIGS. 1-3 with respect to the insulating cavity 40, the first door insulating cavity 56, and/or the second door insulating cavity 64, for example. The insulating cavity can be evacuated at step 154 to decrease a pressure within the insulating cavity to a pressure less than ambient pressure to form a vacuum insulated structure with the insulation packages 46 disposed therein. The vacuum insulated structure can be provided with one or more suitable ports for evacuating the insulating cavity while leaving the insulating cavity sealed in order to maintain the reduced pressure within the insulating cavity.

The insulation packages 46 can be retained within the insulating cavity in any suitable manner. For example, with respect to the exemplary vacuum insulated structure 10 of FIGS. 1-3, a plurality of insulation packages 46 can be formed according to the method 100 of FIG. 4. Each of the insulation packages 46 can be secured to the inner liner 30 in a predetermined position (based on the shape of the insulating cavity 40 at that position) using any suitable mechanical and/or non-mechanical fastener, non-limiting examples of which include clamps, clips, fasteners, supports, adhesives, welds, etc. The outer wrapper 32 can be sealed with the inner liner 30, by the trim breaker 34, for example, to form the insulating cavity 40. The vacuum insulated structures 10*a* and 10*b* having insulation packages 46 disposed therein can be formed in a similar manner.

Figure 6:
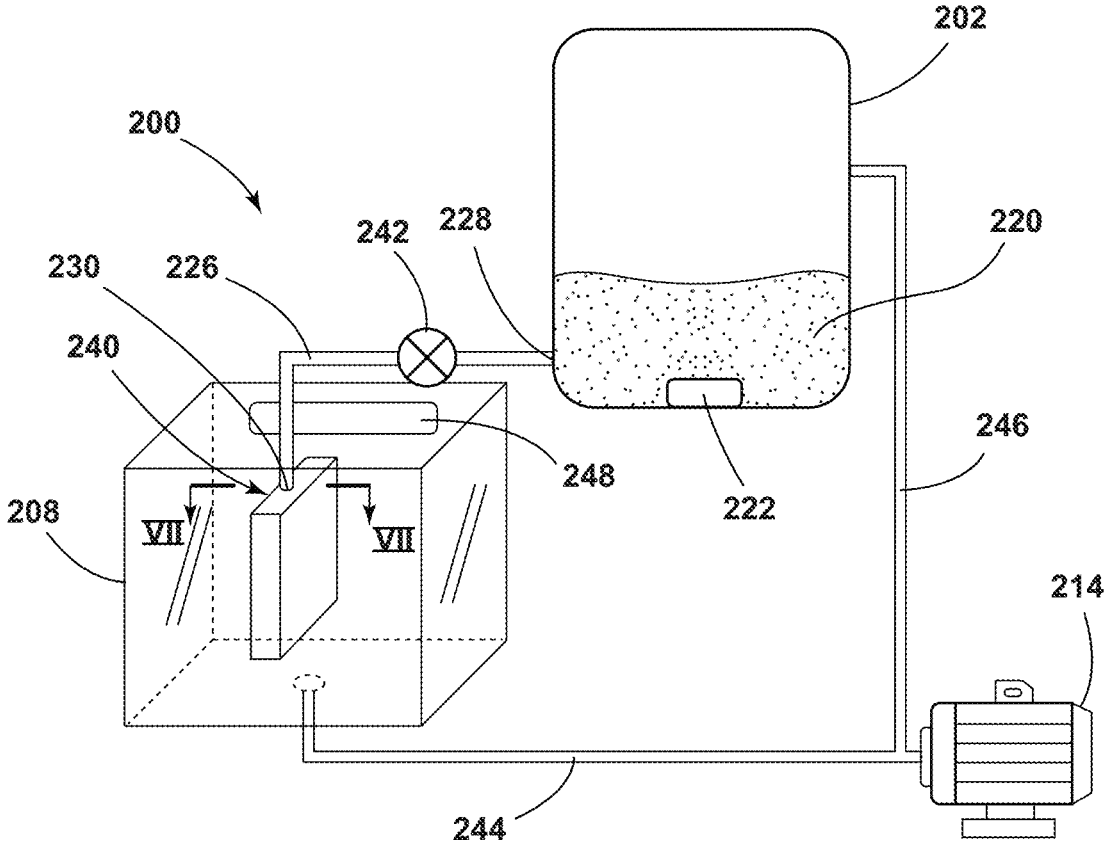
FIG. 6 is a schematic representation of a system for forming an insulation package, according to aspects of the present disclosure.

FIG. 6 illustrates a system 200 that can be used to form the insulation packages 46 according to the method 100 of FIG. 4 or any other suitable method. The system 200 includes a vessel 202, a sealed vacuum chamber 208, and a vacuum pump 214. The vessel 202 is configured to hold a slurry 220 comprising a liquid and an insulation material (such as the insulation material 48). The vessel 202 can optionally be provided with a mixing apparatus 222, such as mixing blades or a stir bar, which is configured to combine the liquid and insulation material 48 to form the slurry 220. In some aspects, the components of the slurry 220 may be at least partially mixed prior to supplying the slurry 220 into the vessel 202.

The vessel 202 is fluidly coupled with the vacuum chamber 208 by a supply conduit 226. The supply conduit 226 is coupled at a first end 228 with the vessel 202 and has a second end 230 that is configured to couple with an envelope 49 (not shown) for selectively supplying the slurry 220 from the vessel 202 to an interior cavity of the envelope 49. The envelope 49 can be supported within the vacuum chamber 208 for coupling with the second end 230 of the supply conduit 226 by a support structure 240. The support structure 240 can be any suitable structure configured to support the envelope 49 in position to be coupled with the second end 230 of the supply conduit 226 during a drawing process whereby the slurry 220 is drawn under vacuum from the vessel 202, through the supply conduit 226, and into the interior cavity of the envelope 49. In some aspects, the support structure 240 can be a mold that is configured to support the envelope 49 in position with the second end 230 and facilitate maintaining the shape of the envelope 49 during the filling of the envelope 49 with the slurry 220.

The supply conduit 226 can be provided with a valve 242 for selectively controlling the flow of material (i.e., gas, liquid, and solids) between the vessel 202 and the interior of the vacuum chamber 208. The valve 242 can be provided anywhere along the supply conduit 226. In some aspects, the valve 242 may be provided anywhere along the path between the vessel 202 and the second end 230 of the supply conduit 226 for selectively controlling the flow of material from the vessel 202 to the second end 230 for supplying the slurry 220 into the interior cavity of the envelope 49.

The vacuum chamber 208 can be any suitable chamber configured to maintain a vacuum, i.e., a reduced pressure less than ambient pressure, inside the vacuum chamber 208. The vacuum chamber 208 is configured to couple with the supply conduit 226 such that the envelope 49 can be disposed within the vacuum chamber 208 and held under vacuum while also being fluidly coupled with the second end 230 of the supply conduit 226. The vacuum chamber 208 can be coupled with the vacuum pump 214 through a vacuum conduit 244 such that the vacuum pump 214 can reduce the pressure within the vacuum chamber 208 to a pressure less than ambient pressure (i.e., draw a vacuum within the vacuum chamber 208 relative to the pressure in the vessel 202). The vacuum conduit 244 can include any suitable traps, filters, etc. in order to protect the components of the vacuum pump 214 from the liquid and any particulate materials that may be present within the vacuum chamber 208. The materials used to form the vacuum conduit 244 and associated components may be made from any suitable metal, metal alloy, and/or polymeric materials suitable for use with the liquid used to form the slurry 220. The vacuum pump 214 may be any suitable pump or system configured to generate a vacuum within the vacuum chamber 208.

The vacuum chamber 208 may be provided with a system for capturing the liquid that is drawn through the envelope 49 during the process of filling the envelope 49 with the slurry 220. In some aspects, a receptacle may be provided within the vacuum chamber 208 for capturing the liquid for later disposal or recycling. In some aspects, the system 200 may be provided with a return conduit 246 which is configured to supply the liquid collected in the vacuum chamber 208 back to the vessel 202 for use in making subsequent batches of the slurry 220. For example, the vacuum pump 214 may include a liquid trap that captures liquid drawn from the vacuum chamber 208, and the return conduit 246 may be coupled with the liquid trap for supplying the liquid back to the vessel 202. In another example, a separate pump and conduit may be coupled with the vacuum chamber 208 for pumping the captured liquid back into the vessel 202. In some aspects, the liquid may be treated prior to returning the liquid to the vessel 202, such as by filtering the liquid and/or drying the liquid. In some aspects, the recycled liquid may be stored in a separate container prior to being supplied to the vessel 202 for re-use.

The system 200 may optionally include a heating element 248 that is configured to dry the insulation material 48 contained within the envelope 49. The heating element 248 can be provided within the vacuum chamber 208 as part of the system 200 or may be a separate component (e.g., a separate heating oven). The heating element 248 can be any suitable component for heating the insulation material 48 and envelope 49 to decrease a water content and/or evaporate the liquid from the insulation material 48 and/or the envelope 49. Non-limiting examples of the heating element 248 include an infrared heater, a halogen lamp, a radiative heating element, a heating coil, an electric heating element, a convection heating system, etc. In some examples, the heating element 248 may be a heating oven or other type of heating component that is not directly associated with the vacuum chamber 208.

In one aspect, the system 200 may be used to fill an envelope 49 with an insulation material 48 to form an insulation package 46 according to the method 100 of FIG. 4 as follows. The valve 242 between the vessel 202 and the second end 230 of the supply conduit 226 can be moved into the closed position. A liquid and insulation material 48, and any optional additives, can be added to the vessel 202 at step 102 to form the slurry 220. The slurry 220 can be mixed prior to supplying the slurry 220 to the vessel 202 and/or after the components have been added to the vessel 202. Optionally, the mixing apparatus 222 may be operated to combine the components forming the slurry 220.

To draw the slurry 220 into the envelope 49 at step 106, the envelope 49 can be placed within the vacuum chamber 208 and fluidly coupled with the second end 230 of the supply conduit 226. The vacuum chamber 208 can be sealed closed and the vacuum pump 214 can be operated to draw a vacuum within the vacuum chamber 208 (i.e., reduce the pressure inside the vacuum chamber 208 to a pressure less than ambient pressure) and create a pressure differential between the interior of the vessel 202 and the interior of the vacuum chamber 208. Once the desired pressure within the vacuum chamber 208 has been reached, the valve 242 can be moved into the open position to allow the slurry 220 to flow from the vessel 202 and into the interior cavity of the envelope 49 through the supply conduit 226. The slurry 220 is drawn from the vessel 202 under vacuum due to the pressure differential between the interior of the vacuum chamber 208 and the interior of the vessel 202 (i.e., a vacuum filling process). Optionally, the vacuum pump 214 may be operated during at least a portion of the time period after the valve 242 is opened. In some aspects, the vacuum pump 214 may be de-activated prior to opening the valve 242 and remain de-activated and/or be re-activated after the valve 242 is opened to continue to draw a vacuum inside the vacuum chamber 208.

The material forming the envelope 49 is permeable to the liquid in the slurry 220 and thus the liquid is drawn through the envelope 49 under vacuum, while at least a portion of the insulation material 48 is retained within the envelope 49. At step 108, the liquid drawn through the envelope 49 can be collected for disposal or recycling.

When the envelope 49 is filled to the desired level, the valve 242 can be moved into the closed position and/or the vacuum pump 214 can be de-activated. Optionally, the heating element 248 can be operated during the drying process 110 to dry the envelope 49 and insulation material 48. As discussed above, higher water content and/or liquid content in the envelope 49 and/or insulation material 48 can increase the evacuation time needed to create a desired vacuum in an insulated vacuum structure containing the insulation packages 46. At step 112, the filled envelope 49 can be uncoupled from the second end 230 of the supply conduit 226 and the open end of the envelope 49 can be sealed to form the insulation package 46. Optionally, as discussed above, the drying process 110 can be implemented following formation of the insulation package 46 at step 112. The thus formed insulation packages 46 can optionally be used in the method 150 of FIG. 5 for forming a vacuum insulated structure, such as the vacuum insulated structures 10, 10*a*, and/or 10*b*.

Figure 7:
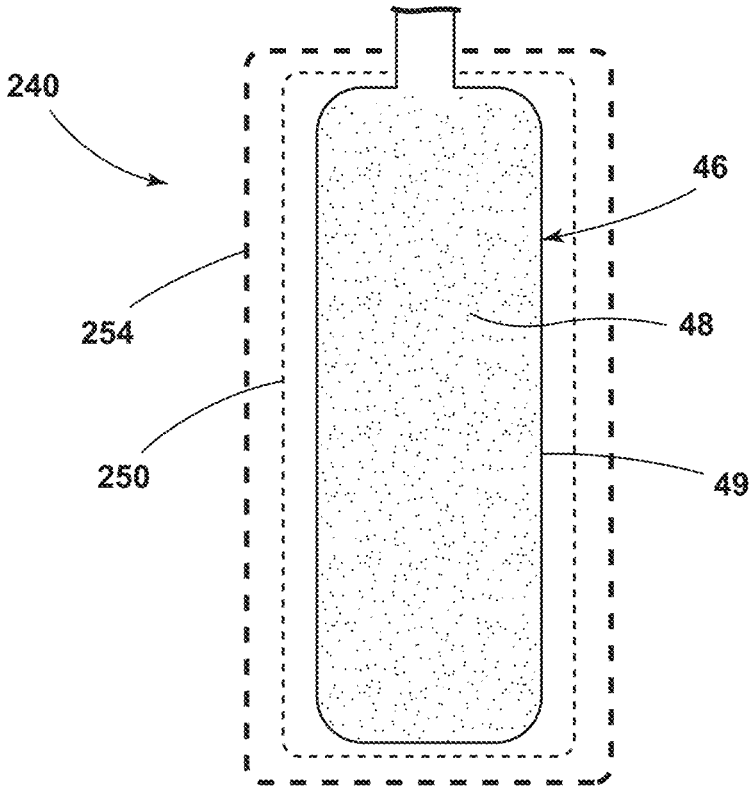
FIG. 7 is a cross-sectional view of a schematic representation of a mold for forming an insulation package, according to aspects of the present disclosure.

FIG. 7 illustrates a support structure 240 in the form of a mold having an inner mold liner 250 and an outer mold shell 254. The inner mold liner 250 and outer mold shell 254 are gas-permeable and permeable to the liquid such that the liquid drawn through the envelope 49 during the vacuum filling process can be drawn through the mold 240. The mold 240 can have any suitable cross-sectional shape and dimensions and can be configured to help retain the shape of the envelope 49 in a desired shape during the vacuum filling process such that the insulation package 46 has the desired shape and dimensions. The inner mold liner 250 can be configured to define a cavity for retaining the envelope 49 therein during the vacuum filling process to draw the slurry 220 into the interior cavity of the envelope 49. The inner mold liner 250 can facilitate filling the envelope 49 such that the final shape of the filled envelope 49 generally corresponds to the desired final shape of the insulation package 46 formed by the filled envelope 49.

In one aspect, the inner mold liner 250 and the outer mold shell 254 include a plurality of apertures or pores (e.g., perforations) that allow the liquid to be drawn through the mold 240 under vacuum. For example, the inner mold liner 250 and outer mold shell 254 can be made from panels containing a plurality of pores. The inner mold liner 250 and outer mold shell 254 can be formed from any metal, metal alloy, or polymeric material that is suitable for use with the liquid. In one aspect, the inner mold liner 250 is formed from panels containing a first set of pores and the outer mold shell 254 is formed from panels containing a second set of pores. The first set of pores in the inner mold liner 250 can have a first pore diameter that is smaller than the diameter of the second set of pores in the outer mold shell 254. The panel thickness, pore diameter, pore density, and pore spacing for each of the inner mold liner 250 and outer mold shell 254 can be selected to provide the desired support for the envelope 49 during the vacuum filling process and to allow for the desired rate of flow of liquid at a given vacuum pressure during the vacuum filling process.

Without wishing to be limited by any theory, it is believed that forming the inner mold liner 250 from a finer mesh material than the outer mold shell 254 (e.g., thinner panels having pores with a smaller diameter) can facilitate maintaining the desired shape of the envelope 49 during filling, which may also facilitate more uniform filling of the envelope 49 with the insulation material 48. However, as the thickness and pore diameter of the inner mold liner 250 decrease, the inner mold liner 250 may not have sufficient strength to maintain structural integrity during the vacuum filling process in some applications. For example, the finer mesh material may bow, bend, or even break during the vacuum filling process. If the inner mold liner 250 is made from thicker panels with the same small diameter pores, it may be too difficult to draw the liquid through inner mold liner 250 at an acceptable rate and vacuum pressure. If the perforations in the mold are too large, in some applications, portions of the envelope material may also get partially drawn through the perforations during the vacuum filling process. The combination of the inner mold liner 250 and the outer mold shell 254 can address these challenges by providing an inner mold liner 250 having a thickness and pore diameter selected to help retain the shape of the envelope 49 during filling and allow a sufficient flow of the liquid through the inner mold liner 250 during the vacuum filling process. The outer mold shell 254 can be made from a thicker, less fine mesh material, and can be used in combination with the inner mold liner 250 to provide structural support to the inner mold liner 250 to facilitate maintaining the inner mold liner 250, and thus the envelope 49, in a desired shape during the vacuum filling process. The outer mold shell 254 can be formed from a material having a thickness and pore diameter selected to provide the inner mold liner 250 with structural support during filling and also allow a sufficient flow of the liquid through the outer mold shell 254 during the vacuum filling process.

In some applications, the support structure 240 may include a mold having a single layer shell, rather than the dual mold design of FIG. 7 including the inner mold liner 250 and outer mold shell 254. In some applications, the support structure 240 may be alternative structures for supporting the envelope 49 within the vacuum chamber 208. For example, the support structure 240 may be in the form of a receptacle, support stand, clamp, and/or other structure capable of holding the envelope 49 in fluid communication with the second end 230 of the supply conduit 226 during the vacuum filling process.

The following non-limiting aspects are encompassed by the present disclosure. To the extent not already described, any one of the features of the first through the twentieth aspects may be combined in part or in whole with features of any one or more of the other aspects of the present disclosure to form additional aspects, even if such a combination is not explicitly described.

According to a first aspect of the present disclosure, a method of forming an insulation package includes the steps of: forming a slurry comprising a liquid and an insulation material in a vessel; providing an envelope inside a sealed chamber, wherein the envelope is gas-permeable and permeable to the liquid and defines an envelope interior cavity; fluidly coupling the envelope interior cavity with the vessel; drawing at least a portion of the slurry from the vessel into the envelope interior cavity by decreasing a pressure within the chamber to less than ambient pressure; and drawing at least a portion of the liquid from the slurry in the envelope interior cavity through the envelope, and wherein at least a portion of the insulation material is retained within the envelope interior cavity to form an insulation material filled envelope.

According to a second aspect of the present disclosure, the method of aspect 1, wherein the step of providing an envelope inside a sealed chamber further comprises providing an envelope within a mold, and wherein the mold is gas-permeable and permeable to the liquid.

According to a third aspect of the present disclosure, the method of aspect 2, wherein the step of providing an envelope within a mold comprises placing the envelope within a cavity at least partially defined by an inner mold liner disposed within an outer mold shell.

According to a fourth aspect of the present disclosure, the method of any of aspects 1-3, further comprising: collecting the liquid drawn through the envelope.

According to a fifth aspect of the present disclosure, the method of any of aspects 1-4, further comprising heating the filled envelope to decrease at least one of a water content and liquid content of the insulation material retained within the envelope interior cavity.

According to a sixth aspect of the present disclosure, the method of any of aspects 1-5, wherein the step of drawing at least a portion of the slurry from the vessel comprises: closing a supply conduit between the envelope and the vessel prior to decreasing a pressure within the chamber to less than ambient pressure; decreasing a pressure within the chamber to less than ambient pressure; and subsequent to decreasing the pressure within the chamber, opening the supply conduit between the envelope and the vessel.

According to a seventh aspect of the present disclosure, the method of any of aspects 1-6, wherein the step of forming a slurry comprises mixing the insulation material with the liquid, wherein the liquid comprises less than 1% water.

According to an eighth aspect of the present disclosure, the method of any of aspects 1-7, wherein the step of forming a slurry comprises mixing the insulation material with the liquid, wherein the liquid is selected from at least one material comprising acetone, methyl ethyl ketone, toluene, and cyclohexane.

According to a ninth aspect of the present disclosure, the method of any of aspects 1-8, wherein the step of forming a slurry comprises mixing the liquid with the insulation material, wherein the insulation material comprises at least one material selected from fumed silica, perlite, precipitated silica, aerogel powder, silicon carbide, carbon black powder, graphite, rice husk, ash powder, diatomaceous earth, glass fiber, glass microspheres, and cenospheres.

According to a tenth aspect of the present disclosure, the method of any of aspects 1-9, wherein the step of providing an envelope inside a sealed chamber comprises providing an envelope comprising at least one material selected from woven textiles, non-woven textiles, fabric, fleece, glass fiber fleece, and polymeric materials.

According to an eleventh aspect of the present disclosure, a method of forming a vacuum insulation structure comprises the steps of: supplying a slurry comprising a liquid and an insulation material to an interior cavity of an envelope, wherein the envelope is gas-permeable and permeable to the liquid; drawing at least a portion of the liquid through the envelope under vacuum, wherein at least a portion of the insulation material is retained within the envelope interior cavity to form an insulation material filled envelope; sealing the insulation material filled envelope with the insulation material therein to form an insulation package; sealing an inner liner with an outer wrapper to form an insulating cavity, wherein the insulation package is disposed within the insulating cavity; and evacuating air from the insulating cavity through at least one vacuum port.

According to a twelfth aspect of the present disclosure, the method of aspect 11, wherein the step of supplying a slurry comprises: forming the slurry in a vessel fluidly coupled with the envelope interior cavity; placing the envelope within a sealed chamber; and decreasing a pressure within the sealed chamber to a reduced pressure less than ambient pressure.

According to a thirteenth aspect of the present disclosure, the method of aspect 11-12, wherein prior to the sealing an inner liner with an outer wrapper, the method further comprises: heating the filled envelope to decrease at least one of a water content and liquid content of the insulation material retained within the envelope interior cavity.

According to a fourteenth aspect of the present disclosure, the method of any one of aspects 11-13, wherein the step of supplying the slurry further comprises: mixing the insulation material with the liquid, wherein the liquid comprises less than 1% water.

According to a fifteenth aspect of the present disclosure, the method of any one of aspects 11-14, wherein the step of supplying the slurry further comprises: mixing the liquid with the insulation material, wherein the insulation material comprises at least one material selected from fumed silica, perlite, precipitated silica, aerogel powder, silicon carbide, carbon black powder, graphite, rice husk, ash powder, diatomaceous earth, glass fiber, glass microspheres, and cenospheres.

According to a sixteenth aspect of the present disclosure, the method of any one of aspects 11-15, further comprising: forming the envelope from at least one material selected from woven textiles, non-woven textiles, fabric, fleece, glass fiber fleece, and polymeric materials.

According to a seventeenth aspect of the present disclosure, a system for forming insulation packages comprises: a vessel configured to hold a slurry comprising a liquid and an insulation material; a supply conduit coupled at a first end with the vessel and having a second end configured to couple with an envelope for selectively supplying the slurry from the vessel to an interior cavity of the envelope; a chamber configured to selectively maintain a pressure within the chamber at a reduced pressure less than ambient pressure, wherein the second end of the supply conduit is disposed within the chamber; and a mold comprising an inner mold liner at least partially defining a cavity for retaining the envelope therein and an outer mold shell at least partially surrounding the inner mold liner, wherein the inner mold liner and the outer mold shell are gas-permeable and permeable to the liquid.

According to an eighteenth aspect of the present disclosure, the method of aspect 17, further comprising: a vacuum pump fluidly coupled with the chamber and configured to selectively decrease the pressure within the chamber to a reduced pressure less than ambient pressure.

According to a nineteenth aspect of the present disclosure, the method of aspect 17 or 18, further comprising: a heating element disposed within the chamber.

According to a twentieth aspect of the present disclosure, the method of any one of aspects 17-19, wherein the inner mold liner comprises a first set of pores having a first pore diameter and the outer mold shell comprises a second set of pores having a second pore diameter, wherein the second pore diameter is greater than the first pore diameter.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A method of forming an insulation package that is configured to limit the transfer of at least one of heat and sound, the method comprising the steps of:

forming a slurry comprising a liquid and an insulation material in a vessel;

providing an envelope inside a sealed chamber, wherein the envelope is gas-permeable and permeable to the liquid and defines an envelope interior cavity, and wherein providing the envelope inside the sealed chamber includes providing the envelope within a mold, and further wherein the mold is gas-permeable and permeable to the liquid;

fluidly coupling the envelope interior cavity with the vessel;

drawing at least a portion of the slurry from the vessel into the envelope interior cavity by decreasing a pressure within the chamber to less than ambient pressure; and drawing at least a portion of the liquid from the slurry in the envelope interior cavity through the envelope, and wherein at least a portion of the insulation material is retained within the envelope interior cavity to form an insulation material filled envelope.

2. The method of claim 1, wherein the step of providing an envelope within a mold comprises placing the envelope within a cavity at least partially defined by an inner mold liner disposed within an outer mold shell.

3. The method of claim 1, further comprising:
collecting the liquid drawn through the envelope.

4. The method of claim 1, further comprising:
heating the filled envelope to decrease at least one of a water content and liquid content of the insulation material retained within the envelope interior cavity.

5. The method of claim 1, wherein the step of drawing at least a portion of the slurry from the vessel comprises:
closing a supply conduit between the envelope and the vessel prior to decreasing a pressure within the chamber to less than ambient pressure; and
decreasing the pressure within the chamber to less than ambient pressure.

6. The method of claim 5, wherein the step of drawing at least a portion of the slurry from the vessel comprises:
subsequent to decreasing the pressure within the chamber, opening the supply conduit between the envelope and the vessel.

7. The method of claim 1, wherein the step of forming a slurry comprises mixing the insulation material with the liquid, wherein the liquid comprises less than 1% water by volume.

8. The method of claim 1, wherein the step of forming a slurry comprises mixing the insulation material with the liquid, wherein the liquid is selected from at least one material comprising acetone, methyl ethyl ketone, toluene, and cyclohexane.

9. The method of claim 1, wherein the step of forming a slurry comprises mixing the liquid with the insulation material, wherein the insulation material comprises at least one material selected from fumed silica, perlite, precipitated silica, aerogel powder, silicon carbide, carbon black powder, graphite, rice husk, ash powder, diatomaceous earth, glass fiber, glass microspheres, and cenospheres.

10. The method of claim 1, wherein the step of providing an envelope inside a sealed chamber comprises providing an envelope comprising at least one material selected from woven textiles, non-woven textiles, fabric, fleece, glass fiber fleece, and polymeric materials.

11. A method of forming a vacuum insulation structure, the method comprising the steps of:
supplying a slurry comprising a liquid and an insulation material to an interior cavity of an envelope, wherein the envelope is gas-permeable and permeable to the liquid;
drawing at least a portion of the liquid through the envelope under vacuum, wherein at least a portion of the insulation material is retained within the envelope interior cavity to form an insulation material filled envelope;
sealing the insulation material filled envelope with the insulation material therein to form an insulation package;
sealing an inner liner with an outer wrapper to form an insulating cavity, wherein the insulation package is disposed within the insulating cavity; and
evacuating air from the insulating cavity through at least one vacuum port.

12. The method of claim 11, wherein the step of supplying a slurry comprises:
forming the slurry in a vessel fluidly coupled with the envelope interior cavity; and
placing the envelope within a sealed chamber.

13. The method of claim 12, wherein the step of supplying a slurry comprises:
decreasing a pressure within the sealed chamber to a reduced pressure less than ambient pressure.

14. The method of claim 11, wherein prior to the sealing an inner liner with an outer wrapper, the method further comprises:
heating the filled envelope to decrease at least one of a water content and liquid content of the insulation material retained within the envelope interior cavity.

15. The method of claim 11, wherein the step of supplying the slurry further comprises:
mixing the insulation material with the liquid, wherein the liquid comprises less than 1% water by volume.

16. The method of claim 11, wherein the step of supplying the slurry further comprises:
mixing the liquid with the insulation material, wherein the insulation material comprises at least one material selected from fumed silica, perlite, precipitated silica, aerogel powder, silicon carbide, carbon black powder, graphite, rice husk, ash powder, diatomaceous earth, glass fiber, glass microspheres, and cenospheres.

17. The method of claim 11, further comprising:
forming the envelope from at least one material selected from woven textiles, non-woven textiles, fabric, fleece, glass fiber fleece, and polymeric materials.

* * * * *